United States Patent [19]

Newton

[11] 4,066,926

[45] Jan. 3, 1978

[54] GAS-FILLED INCANDESCENT LAMP WITH INTEGRAL FUSE ASSEMBLY

[75] Inventor: Ralph E. Newton, Dover, N.J.

[73] Assignee: Westinghouse Electric Corporation, Pittsburgh, Pa.

[21] Appl. No.: 731,393

[22] Filed: Oct. 12, 1976

[51] Int. Cl.[2] ..... H01J 7/44; H01J 13/46; H01J 17/34; H01J 19/78

[52] U.S. Cl. ..... 315/73; 315/100; 315/107

[58] Field of Search ..... 315/73, 74; 313/315

[56] References Cited

U.S. PATENT DOCUMENTS

| | | | |
|---|---|---|---|
| 3,211,943 | 10/1965 | Cardwell, Jr. | 313/315 |
| 3,274,426 | 9/1966 | Scoledge et al. | 315/74 |
| 3,743,375 | 7/1973 | De Fraeye | 313/315 |
| 3,864,598 | 2/1975 | Cardwell, Jr. | 313/315 |

*Primary Examiner*—Alfred E. Smith
*Assistant Examiner*—Edward Tyler
*Attorney, Agent, or Firm*—D. S. Buleza

[57] ABSTRACT

Protection against potentially destructive arcs which may occur within a gas-filled incandescent lamp when the energized filament fails is achieved by partly embedding separate inner and outer lead-in conductors in an hermetic seal that is formed on one end of the lamp envelope and electrically connecting the conductors by a short uncoiled fuse element that is located entirely within the confines of the envelope. In the case of a halogen-cycle type lamp having a press-sealed envelope, the fuse element comprises a tungsten wire which is preferably from about 1% to 10% larger in diameter than the filament wire and is fastened to the inner lead-in conductor at a point located inside the envelope, and to the outer lead-in conductor at a point which is located within the press seal. Reliable arc-suppression is thus achieved in a practical inexpensive manner with rugged components that are readily made integral parts of the finished lamp.

10 Claims, 6 Drawing Figures

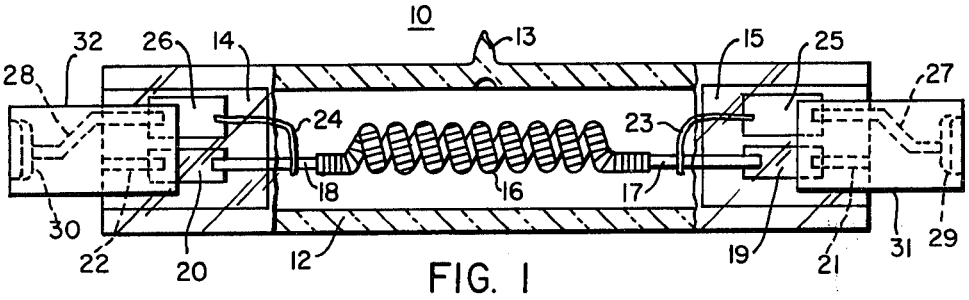
FIG. 1
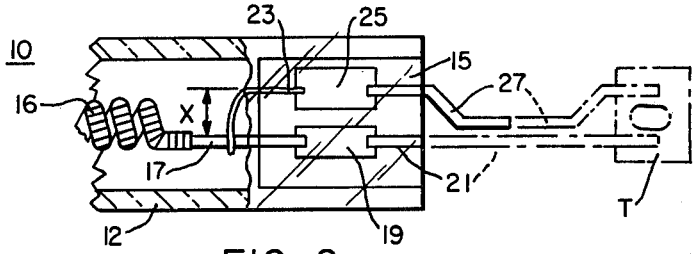
FIG. 2
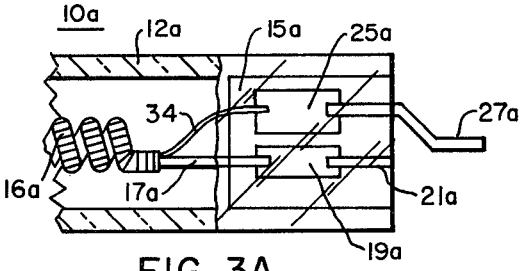
FIG. 3A
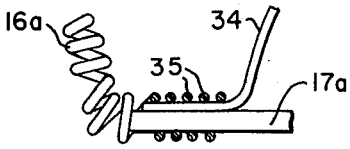
FIG. 3B
FIG. 4A
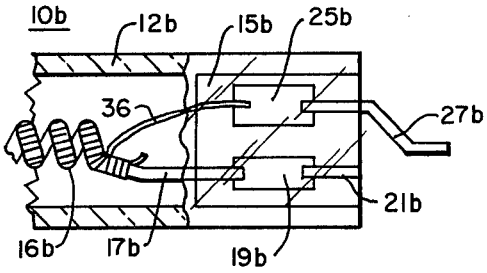
FIG. 4B
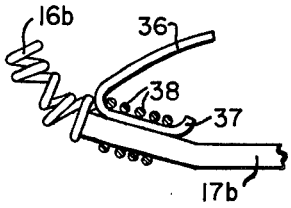

GAS-FILLED INCANDESCENT LAMP WITH INTEGRAL FUSE ASSEMBLY

BACKGROUND OF THE INVENTION

1. Field of the Invention:

This invention relates to the electric lamp art and has particular reference to an improved integral fuse structure for a gas-filled incandescent lamp.

2. Description of the Prior Art:

Incandescent electric lamps that contain an inert fill gas and are provided with an integral fuse component are well known in the art. A double-ended halogen-cycle incandescent lamp which contains a coiled-coil filament that is terminated by an uncoiled leg section which functions as a fuse and is fastened to the end of a lead-in conductor that is embedded in the envelope seal is disclosed in U.S. Pat. Nos. 3,211,942 and 3,211,950, issued Oct. 12, 1965. A modified lamp of this type in which the combined functions of a fuse and a filament support are achieved by a wire member that is fastened to the embedded end of the lead-in conductor and has its opposite end wound around the singly-coiled leg segment of a coiled-coil filament to provide an inter-wound juncture is disclosed in U.S. Pat. No. 3,211,943, which was also issued on Oct. 12, 1965.

A fuse assembly that constitutes an integral part of a double-ended incandescent lamp but is disposed within a ceramic cap attached to the press seal and is thus located outside of the lamp envelope is disclosed in U.S. Pat. No. 3,274,426, issued Sept. 20, 1966. An improved exterior fuse assembly for such a lamp in which a separate support wire for the lamp contact is employed and connected to a protruding portion of the lead-in conductor by the fuse wire is shown in U.S. Pat. No. 3,346,768, issued Oct. 10, 1967.

Halogen-cycle type incandescent lamps having fuse elements in the form of rods or metal foils that are embedded in the press seals and connected to the end of the coiled filament are disclosed in U.S. Pat. No. 3,710,169, issued Jan. 9, 1973 and Japanese Patent Publication No. 47-11421 of Ito et al, published Apr. 27, 1972. A double-ended incandescent lamp having an internal fuse element in the form of a wire that is coiled around a separate spud wire which is connected to one end of the filament and is embedded in the press seal is illustrated in U.S. Pat. No. 3,864,598, issued Feb. 4, 1975. The uncoiled end of the fuse wire is connected to a foil conductor embedded in the seal, thus completing the electric circuit. A single-ended halogen-cycle incandescent lamp having an internal fuse in the form of a coiled wire that is connected to the inwardly-extending ends of an internal lead wire and an external lead-in conductor assembly that are both embedded in the hermetic seal and both protrude into the envelope is disclosed in Japanese Patent Publication No. 48-30707 of Toyoda, published Sept. 19, 1973. A single-ended halogen-cycle projection type incandescent lamp with an internal platinized fuse wire is disclosed in U.S. Pat. No. 3,727,091 issued Apr. 10, 1973 to A. R. DeCaro.

While the prior art structures which employed external fuse components were generally satisfactory from a functional standpoint, they were rather complicated and expensive in that they required several accurately-formed parts to hold and protectively enclose the fuse assembly. Even though the expense of such additional parts was eliminated by using internal fuse components, the prior art practice of using a coiled fuse wire or coiling one end of an internal fuse wire around the filament leg or a spud wire made it difficult and expensive to manufacture the lamp since highly-skilled manual labor was required to make such assemblies. In addition, the resulting electrical juncture of the parts was not very rugged or reliable and left much to be desired from the standpoint of a positive and durable electrical connection.

In some cases, the spacing between the internal metal components of the lamp was so close that the electric arc could easily "bridge" the gap between them after the fuse element melted, thus preventing reliable arc-suppression as the lamp failed and creating a potential saftey hazard.

SUMMARY OF THE INVENTION

The foregoing quality and manufacturing problems are avoided in accordance with the present invention by utilizing an internal fuse element that consists of a short length of uncoiled wire having one end fastened inside the envelope to an inner lead-in conductor that is anchored in the press seal, and its opposite end embedded in the press seal and fastened to the embedded portion of an outer lead-in conductor assembly that is separate and physically isolated from the inner lead-in conductor. The fuse wire is thus firmly held in place by the hermetic seal which is formed on the end of the vitreous envelope. The part of the fuse wire that is located within the envelope can be readily connected to the inner lead-in conductor by welding, or the juncture of this conductor with the coiled-coil filament can be effected by inserting the end of the fuse wire into the filament leg along with the end of the inner conductor and hot clamping the components together.

In the case of a halogen-cycle incandescent lamp, the fuse wire preferably consists of a tungsten wire that has a diameter which is from about 1% to 10% larger than the filament wire diameter. The larger cross-sectional area of the fuse wire permits the part of the fuse wire that is located within the envelope and exposed to the halogen atmosphere to operate at a lower temperature than the filament wire, thus insuring that the fuse wire will remain in place and remain operative throughout the useful life of the lamp. The use of such a slightly larger-diametered fuse wire also avoids any possibility that nicks or other imperfections in the wire could cause "hot spots" to develop in the fuse during lamp operation with subsequent rapid evaporation and premature severance of the fuse element.

The use of an uncoiled segment of wire as the fuse element and combining it with separate physically-isolated inner and outer lead-in conductor components provides an additional important advantage in that the part of the fuse wire that is located within the envelope is exposed to the heat generated by the energized filament and thus has a much higher operating temperature than a fuse element which is embedded within the envelope seal or located outside the envelope. This permits the fuse wire to melt through and provide a quicker fusing action should an arc develop within the lamp. The novel fuse structure also provides a wide "gap" or spacing between the lead-in conductor components when the fuse is melted, thus insuring positive and reliable arc-suppressing action when the need arises.

BRIEF DESCRIPTION OF THE DRAWING

A better understanding of the invention will be obtained from the exemplary embodiments shown in the accompanying drawing, wherein:

FIG. 1 is an enlarged side elevational view of a double-ended halogen-cycle type incandescent lamp made in accordance with the invention, a portion of the envelope being removed for illustrative purposes;

FIG. 2 is a side elevational view of one end of the lamp shown in FIG. 1 before the external contact element and its protective sleeve have been attached;

FIG. 3A is a similar view of an end portion of an alternative lamp embodiment;

FIG. 3B is an enlarged elevational view, partly in section, of the juncture which electrically connects the fuse wire with the filament leg and inner lead-in conductor of the alternative lamp embodiment shown in FIG. 3A; and FIGS. 4A and 4B are similar views of the end portion and filament-conductor-fuse wire juncture of still another embodiment of the invention.

DESCRIPTION OF PREFERRED EMBODIMENTS

While the present invention can be employed in various types of gas-filled incandescent lamps that require a fuse component to suppress electric arcs within the lamp during operation which could possibly destroy the integrity of the envelope and cause it to explode, it is particularly adapted for use in double-ended halogen-cycle type incandescent lamps and has accordingly been so illustrated and will be so described.

A representative halogen-cycle incandescent lamp 10 which embodies the present invention is shown in FIG. 1. As illustrated, the lamp 10 is of the double-ended variety and has an elongated tubular envelope 12 of suitable radiation-transmitting vitreous material that has a high-melting point and can withstand the elevated operating temperatures and gas pressures involved, as well as the effects of the halogen atmosphere, without deteriorating or becoming deformed or bursting. Examples of suitable vitreous materials are quartz, borosilicate glass, and other hard glasses that principally comprise fused silica.

The envelope 12 is hermetically sealed by a protruding tipped-off segment 13 of an exhaust tubulation and by press seals 14 and 15 that are formed in the usual manner by heating and then collapsing and compressing the ends of the envelope to form a solid mass of glass or quartz. A tungsten wire filament 16 of the coiled-coil type is longitudinally suspended and centrally located within the envelope 12. It is held in such position by a pair of rigid inner lead-in conductors, such as tungsten or molybdenum wires 17 and 18 that are embedded in the respective press seals and have their opposite ends inserted into and electrically connected with singly-coiled legs of the coiled filament 16. The embedded ends of the inner lead-in wires 17 and 18 are connected to ribbon-like conductors such as molybdenum foil strips 19 and 20 that are hermetically sealed within the associated press seals. Each of the foil conductors 19 and 20 has an additional rigid conductor such as a tungsten or molybdenum wire 21 and 22 attached to its end. These additional conductors are both embedded in the respective press seals and extend toward and terminate at the end surfaces thereof.

The envelope 12 contains an inert fill gas (such as nitrogen, krypton, argon, xenon and mixtures thereof) at a suitable pressure (at least 760 Torr). It also contains a predetermined amount of a halogen, such as iodine or bromine, that is dosed into the lamp in elemental form or as part of a thermally-decomposable compound ($SnI_4$ for example). Lamps of this type are made in various sizes and ratings ranging from 45 watts to 1000 watts and 30 volts to 135 volts.

In accordance with the present invention, the incandescent lamp 10 is provided with an integral fuse assembly at each end. The assemblies consist of suitable fusible elements such as a pair of uncoiled segments of tungsten wire 23 and 24 that are electrically connected, as by spot welding, to the associated inner lead-in conductors 17 and 18 at points that are located within the envelope 12. The opposite ends of the tungsten fuse wires 23 and 24 extend into and are embedded in the associated press seals 15 and 14 where they are electrically joined, as by welding, to a second pair of ribbon-like conductors such as molybdenum foil strips 25 and 26 which are also embedded in the press seals and spaced laterally from the other pair of foil strips 19 and 20. A pair of rigid outer lead-in conductors such as tungsten or molybdenum wires 27 and 28 are electrically connected to the outermost ends of the foil strips 25 and 26 and are partly embedded in and thus securely anchored in the associated press seals. The protruding ends of the outer lead-in conductors 27 and 28 are fastened to metal contact buttons 29 and 30 which serve as the lamp terminals. The exposed ends of the outer lead-in conductors and their associated contact buttons are protectively enclosed and recessed within ceramic sleeves 31 and 32 that are cemented to the press seals 14 and 15 in accordance with standard lamp-making practice.

The incandescent lamp 10 is thus provided with lead-in conductor and fuse assemblies which permit electric current to flow from terminal or contact button 29, through the outer lead-in conductor 27, the connecting foil conductor 25, fuse wire 23, the coiled-coil filament 16 and to the connected end portion of the other inner lead-in conductor 18 and its associated fuse and conductors. A portion of each of the tungsten fuse wires 23 and 24 is thus embedded and securely anchored in the associated press seals 14 and 15, whereas the remaining parts of the fuse wires are located within the envelope adjacent the filament 16. The fuse wires 23, 24 are thus securely anchored in place and, at the same time, are exposed to the intense heat generated by the incandescent filament 16. The inwardly-disposed portions of the fuse wires accordingly operate at a much higher temperature that the portions that are embedded in the press seals and are thus inherently capable of being heated quickly to melting temperature when the lamp current increases rapidly — thus providing a reliable and fast "fusing action" which quickly suppresses any electric arcs that may develop within the lamp 10 during operation.

In order to avoid the possibility that the short lengths of fuse wire 23 and 24 will operate at an excessively high temperature and thus undergo erosion by evaporation of tungsten during lamp operation, they are preferably fabricated from tungsten wire that is slightly larger in diameter than the tungsten wire from which the coiled filament 16 is wound. The diameter of the fuse wire is from about 1% to 10% (and preferably from about 2% to 5%) larger than the filament wire diameter, and thus has a larger cross-sectional area and lower resistance per unit length than the filament wire. In the case of a 400 watt lamp designed for operation at 120 volts and having a coiled-coil filament wound from tunsten wire approximately 0.167 millimeter in diameter, the foregoing criteria requires that the fuse wires be fabricated from tungsten wire from about 0.169 to 0.184 millimeter in diameter (1% to 10% diameter increase).

Using fuse wires that are slightly larger in diameter than the filament wire affords the additional advantage that "nicks" or other surface imperfections in the fuse wire can be tolerated without creating hot spots in the wire during lamp operation which could cause the fuse to melt through prematurely and ruin the lamp. This advantage applies to halogen and non-halogen type lamps.

The use of a pair of separate ribbon-like conductors that are connected to separate and physically-isolated inner and outer lead-in conductors which are electrically connected by a fuse wire in accordance with the invention provides additional functional and manufacturing advantages. These features are shown in FIG. 2. As indicated by the dotted outline portion of this figure, the outer lead-in wire 27 and additional lead-in wire 21 are initially longer and have their outer ends spot-welded to a metallic bridging-tab T which holds the entire lead wire, ribbon and fuse assembly together while it is being attached to the leg of the coiled filament 16. The resulting unitary assembly can thus be accurately and rapidly fabricated automatically using suitable jigs and welding equipment. After the assembly has been sealed within the envelope 12, the lead-in wire 21 is severed flush with the outer edge of the press seal 15 and the outer lead-in conductor 27 is severed at the proper point to provide a protruding portion of the required length.

The various lead-in conductor components are so arranged and spaced that a wide gap (dimension $x$ in FIG. 2) is provided between the inner lead 17 and the embedded portion of the fuse wire 23 when the portion of the fuse wire that is located inside the envelope 12 has melted and been removed. This provides a very reliable and positive arc-suppression action. The wide gap is achieved by laterally-offsetting the outer and inner lead-in conductors from each other in the manner shown. To insure good arc-suppression, dimension $x$ should be at least 2 mm. Of course, this dimension will vary depending upon the type of fill gas and fill pressure which are employed. Larger gap dimensions are required for higher fill pressures and with fill gases, such as argon, which has a low ionization potential (compared to nitrogen, for example). In 400 watt lamps of the types shown in FIG. 1 that contained 90% argon-10% nitrogen as the fill gas at a pressure of about 1700 Torr (at 20° C), excellent fusing action and arc-suppression has been achieved with a gap dimension of approximately 4 mm. The fact that the fuse wires melt is such a manner that the melted remnants or "stubs" are automatically slightly recessed within and shielded by the associated press seals enhances the arc-suppression ability of the fuse assemblies.

While the integral fuse elements 23 and 24 are preferably fabricated from tungsten wire to facilitate making the welds which join them to the foil conductors 25, 26 and inner lead-in conductors 17 and 18, they can be fabricated from other suitable metals or alloys that have the proper electrical conductivity characteristics and will provide the desired fusing action. In the case of halogen-cycle type lamps, the fuse wire material must also be able to withstand the corrosive effects of the halogen atmosphere within the lamp. It is thus within the scope of the invention to use fuse wires that are fabricated from uncoiled wire that is composed of a metal or alloy that is not tungsten but which is clad or coated with tungsten and is thus able to withstand the halogen atmosphere within the envelope. Fuse wires that are composed of platinum-coated nickel or Nichrome alloy wire in accordance with U.S. Pat. No. 3,727,091 granted Apr. 10, 1973 to A. DeCaro can thus also be used.

The invention is also not limited to fuse wires that are welded to the inner lead-in conductors. In an alternative lamp embodiment **10*a*, shown in FIG. 3A, the uncoiled fuse wire 34 is inserted into the adjacent singly-coiled leg of the coiled-coil filament 16*a* along with the end of the inner lead-in conductor 17*a*. As shown more clearly in FIG. 3B, the end of the fuse wire 34 is interposed between the end portion of the inner lead-in wire 17*a* that is enclosed by the turns 35 of the coil leg. The resulting assembly is subjected to a "hot-clamping" operation (well-known to those in the art) so that one or more of the coil turns 35** are permanently deformed and securely grip the ends of the fuse wire and lead-in conductor and form a positive rugged electrical juncture.

Still another alternative lamp embodiment **10*b* is shown in FIG. 4A. In accordance with this embodiment, the inner end of the fuse wire 36 is formed into a loop or "hook" which is inserted between the primary turns of the coiled-coil filament 16*b* at the point where the filament leg begins so that the hooked end slips into the leg and is entrapped by the inserted end portion of the inner lead-in conductor 17*b*. As shown more clearly in FIG. 4B, the free end 37 of the hooked portion of the fuse wire 36 is preferably bent upwardly and the turns 38 of the filament leg enclose the inserted ends of the lead-in conductor and fuse wire. A positive electrical juncture is again effected by a hot-clamping operation that deforms one or more turns 38** of the coil leg and causes them to securely grip the enclosed portions of the conductor and fuse wire.

While the illustrated lamp embodiments are of double-ended construction and have an inner fuse element provided at each end, the invention is not limited to this type lamp or number of fuse elements. Hence, a single fuse element at only one end of a double-ended type lamp, or at the sealed end of a single-ended type lamp, can be employed pursuant to the invention.

I claim as my invention:

1. An electric incandescent lamp comprising;

a vitreous envelope that contains an inert fill gas and is terminated at one end by an hermetic seal which has a pair of spaced ribbon-like conductors embedded therein, a filament or refractory metal wire suspended within said envelope, an inner lead-in conductor having one end disposed within the envelope and fastened to said filament and its other end embedded in said hermetic seal and connected to one of the ribbon-like conductors, means for preventing the formation of a destructive electric arc within the energized lamp when the filament fails comprising a non-coiled member of fusible metal that has one end electrically connected to a non-embedded part of said inner lead-in conductor which is located within said envelope and its opposite end embedded in the hermetic seal and fastened to the other of said ribbon-like conductors, and external connector means comprising an outer lead-in conductor that protrudes from said hermetic seal and has an end segment which is embedded in said hermetic seal and is electrically connected to the ribbon-like conductor which is fastened to said fusible metal member, said hermetic seal having an additional conductor member embedded therein which extends from an exposed surface of the hermetic seal toward and is secured to the ribbon-like conductor that is fastened to the inner lead-in conductor.

2. The gas-filled incandescent lamp of claim 1 wherein;

the said one end of the envelope is of tubular configuration, and said hermetic seal comprises a press seal that is defined by collapsed walls of the tubular end of said envelope which are compressed into a solid mass of fused vitreous material.

3. The gas-filled incandescent lamp of claim 1 wherein said fusible metal member comprises a length of wire that is welded to the inner lead-in conductor.

4. The gas-filled incandescent lamp of claim 1 wherein;

said filament is of coiled configuration and consists essentially of tungsten wire that is of substantially uniform diameter, said envelope also contains a halogen which provides a regenerative atmosphere within the energized lamp that returns vaporized tungsten to the coiled filament and said lamp thus comprises a halogen-cycle lamp, and said non-coiled member of fusible metal comprises a wire that does not chemically react with said halogen.

5. The halogen-cycle incandescent lamp of claim 4 wherein said fusible wire is composed essentially of tungsten and has a substantially uniform diameter which is larger than the filament wire diameter so that the resistance per unit length of said fusible wire is thus lower than that of the filament wire.

6. The halogen-cycle incandescent lamp of claim 5 wherein the diameter of said fusible tungsten wire is from about 1% to 10% larger than that of said filament wire.

7. The halogen-cycle incandescent lamp of claim 4 wherein;

said envelope is of tubular configuration throughout the major part of its length and is terminated at each end by a press seal one of which contains said embedded pair of ribbon-like conductors, additional conductor and the associated embedded ends of said fusible tungsten wire and said inner and outer lead-in conductors, said inner lead-in conductor comprises a rigid wire which is composed of a metal that is not subject to chemical attack by the halogen, and said ribbon-like conductors are disposed in side-by-side relationship within the associated press seal and extend along the longitudinal axis of the envelope.

8. The double-ended halogen-cycle incandescent lamp of claim 7 wherein said fusible metal wire is composed essentially of tungsten and is welded to said inner lead-in conductor and the associated ribbon-like conductor.

9. The double-ended halogen-cycle incandescent lamp of claim 7 wherein;

said coiled filament is of the coiled-coil type that has a longitudinally-extending singly-coiled leg at the end thereof which is proximate said one press seal, the associated end of said inner lead-in wire is located within the turns of said singly-coiled filament leg, the associated end of said fusible metal wire is disposed between the inner lead-in wire and the overlying turns of said filament leg and the respective components are held in positive electrical contact with one another by at least one deformed turn of the filament leg which clamps said leg around the underlying end segments of the fusible metal wire and inner lead-in wire.

10. The double-ended halogen-cycle incandescent lamp of claim 7 wherein;

said coiled filament is of the coiled-coil type and is terminated at one end by a singly-coiled leg that extends toward said one press seal, the associated end of said inner lead-in wire is disposed within said filament leg, the associated end of said fusible metal wire is generally hook-shaped and extends between adjacent turns of the filament leg and along said leg between the end portion of the inner lead-in wire and the overlying turns of said filament leg, and the interfitted ends of the fusible metal wire, inner lead-in wire and the filament leg are held in positive electrical contact with one another by at least one overlying turn of the filament leg that is deformed and clamps the respective components together.

* * * * *